United States Patent [19]

Dutcher et al.

[11] 4,405,078

[45] Sep. 20, 1983

[54] ARTICLE CARRIER AND A BLANK FOR FORMING THE SAME

[75] Inventors: Daniel P. Dutcher, Woodbury, Minn.; Harry I. Roccaforte, Western Springs, Ill.

[73] Assignee: Champion International Corporation, Stamford, Conn.

[21] Appl. No.: 116,909

[22] Filed: Jan. 30, 1980

[51] Int. Cl.[3] ..... B65D 5/46

[52] U.S. Cl. ..... 229/52 B; 206/434; 206/611; 206/621

[58] Field of Search ..... 229/44 CB, 45, 52 B, 229/52 BC; 206/427, 428, 434, 621, 624, 162, 611

[56] References Cited

U.S. PATENT DOCUMENTS

| | | | |
|---|---|---|---|
| 2,718,301 | 9/1955 | Palmer | 229/52 B X |
| 2,872,036 | 2/1959 | Forrer | 206/162 X |
| 3,019,957 | 2/1962 | Palmer | 229/45 X |
| 3,112,856 | 12/1963 | Macintosh et al. | 229/52 B |
| 3,554,402 | 1/1971 | Lock | 229/52 B X |
| 4,165,832 | 8/1979 | Kuklies et al. | 229/54 R |
| 4,222,485 | 9/1980 | Focke | 229/52 B X |
| 4,340,170 | 7/1982 | Montealegre | 229/52 B |

FOREIGN PATENT DOCUMENTS

| | | | |
|---|---|---|---|
| 712905 | 7/1965 | Canada | 229/52 B |
| 2052618 | 1/1980 | Fed. Rep. of Germany | 206/434 |
| 6600434 | 7/1966 | Netherlands | 229/52 B |

*Primary Examiner*—William Price

*Assistant Examiner*—Gary E. Elkins

*Attorney, Agent, or Firm*—Evelyn M. Sommer

[57] ABSTRACT

An article carrier and a blank for forming the same is provided having an integral carrying handle which is configured to relieve local stress in the area of the handle which would otherwise tend to tear or deform the paperboard material from which the carrier is formed. More particularly, a cut line is provided in a top panel of the carrier which defines a handle tab that pivots about a hinge line. In addition, the cut line includes two straight portions which extend beyond the top panel into the opposed side panels of the carrier and are contiguous with a pair of stress relieving apertures also disposed in the opposed side panels. The opposed straight cut portions are positioned in coplanar relationship with the hinge line of the shiftable handle tab such that when the carrier is transported, the local stress, developed in the carton, created by the weight of the contents of the carrier are distributed to the side panels via the straight portions of the cut line as well as the stress relieving apertures, thereby reducing the likelihood of the tearing of the carrier. In addition, the carrier is provided with an openable flap which is formed in a side panel thereof and extends into a primary end cover flap. The openable flap is provided with a locking strap which is pivotally connected to the side panel of the carrier. The locking strap includes a locking tab that is adapted to be interengaged with a locking aperture provided in a secondary end cover flap for resealing the carrier.

7 Claims, 4 Drawing Figures

ARTICLE CARRIER AND A BLANK FOR FORMING THE SAME

The subject invention relates to an article carrier and a blank for forming the same. More particularly, an article carrier is provided with an integral carrying handle means which functions to relieve local stress in the area of the handle which would tend to tear or deform the paperboard material from which the carrier is formed. In the preferred form of the invention, an openable flap is provided to allow access to the contents of the carrier while improved locking means maintain the openable flap in its initial closed position after the carrier has been used.

Prior art paperboard containers having handles formed integrally therewith, generally require the use of additional paperboard material, beyond that which is necessary to form a generally tubular container. The use of additional paperboard material to form stronger and reinforced integral handles is especially necessary when the containers are large and intended for use to carry heavy items such as a plurality of 6-packs of soda or beer. Containers of the prior art, which are provided with integral handles formed directly in the paperboard material, without the use of additional structural supporting members, were subject to frequent tearing along local stress lines of the handle. More specifically, the paperboard, adjacent the non-reinforced handles of prior art containers, would tend to tear, or deform as the container was being carried.

Many prior art containers are provided with an openable flap for gaining access of the contents of the carton, and in addition are provided with a means for reclosing this flap until further use. However, when the containers are very large, and are intended to carry heavy articles, the openable flap must necessarily also be very large. In these prior art larger containers, the means for relocking the openable flap are generally inadequate to reclose the openable flap against the pressure exerted by the heavy articles within the container.

Accordingly, it is a primary object of the subject invention to provide an article carrier which has an integral handle formed directly from the paperboard of the carrier, which includes stress relieving means to prevent the inadvertent tearing of the paperboard in the area of the handle when the carrier is being transported.

It is a further object of the subject invention to provide an article carrier of the type described above having an openable flap to readily provide access to the contents of the carrier and a new and improved means for reclosing the flap to reseal the contents within the carrier.

It is another object of the subject invention to provide an article carrier of the type mentioned above having a means for reclosing an openable flap wherein said means are formed integrally with said container.

It is still a further object of the subject invention to provide an article carrier wherein the side panel which is opposed to the openable flap, includes a reinforcing strip to increase the structural rigidity of the carton.

In accordance with these and many other objects, the subject invention provides an article carrier formed from a one piece cardboard blank, consisting of opposed top and bottom panels, and opposed first and second side panels, with the top, bottom and side panels being alternatively hingedly connected to form a generally rectangular tubular configuration. The carrier of the subject invention is further provided with first and second end closures which are hingedly connected to the opposed ends of the rectangular tubular container. A handle means is provided which is defined by a cut line, a portion of which is arcuate in configuration and is disposed in the top panel of the carrier. The arcuate portion of the cut line extends between the opposed side edges of the top panel adjacent the side panels, and defines a foldable handle tab. The cut line additionally includes a pair of straight portions which extend a short distance beyond the side edges of the top panel and are formed in the opposed side panels of the container. The straight portions of the cut line are disposed in orthogonal relationship to the hinged connections between the top panel and the opposed side panels, and are coplanar with the hinge line of the handle tab in the top panel. In accordance with the subject invention, the handle means additionally includes a pair of stress relieving apertures which are respectively disposed in the opposed side panels and are contiguous with the distal ends of the associated straight portions of the cut line. When the carrier is to be lifted, the foldable handle tab is pivoted out of the plane of the top panel, forming an opening therein, which may be readily grasped by the hand of the user. The weight of the contents of the carton, which creates localized stresses at the opposed end points of the handle tab is distributed along the straight portions of the cut line to the opposed side panels, and are dispersed via the stress relieving apertures, such that the likelihood of the paperboard tearing adjacent the ends of the handle tab is substantially reduced. Thus, the stress relieving apertures of applicant's new and improved handle means functions to more evenly distribute the downward biasing force of the weight of the contents of the carrier rather than permitting this force to be concentrated at the end points of the hinged connection to the handle tab.

Optionally, the article carrier may be further provided with an openable flap such that the consumer can readily attain access to the contents of the carrier. The openable flap is defined by a pair of spaced apart cut score lines which are formed in the first side panel and extend into a primary cover flap which forms part of the first end closure. The first end closure additionally includes a secondary cover flap which is at least partially overlapped by the primary cover flap. The openable flap may be opened by outwardly flexing the flap, beginning along the side edge of the primary end cover flap, thereby tearing the cut score lines formed in the carrier. The consumer may continue to tear the cut score lines until enough of the openable flap is flexed away from the carrier to create a sufficient opening to enable the user to remove the contents therein.

Also, in the preferred form of the invention disclosed herein, the article carrier is further provided with a means for reclosing the openable flap. More particularly, the locking means includes a locking strap which is formed in the first side panel and is disposed between, and spaced from, the cut score lines in the side panel. The locking strap is hingedly connected to the carrier along the hinged connection between the first side panel and the primary cover flap and includes a locking tab disposed on the end thereof opposed to the hinged connection. The locking means of the subject invention further includes a locking aperture which is formed in the secondary cover flap of the first end closure. The locking aperture is disposed at a point in the secondary cover flap which is not overlapped by the primary cover flap and is positioned to receive the locking tab of the locking strap. When the carton is to be reclosed the locking strap is pivoted about its hinged connection and rotated such that the locking tab may be interengaged with the locking aperture in the secondary cover flap to thereby maintain the openable flap in its initial, closed position. By this arrangement, the carrier may be transported with some of its contents still inside without the danger of the contents inadvertently spilling out of the container.

Further objects and advantages of the subject invention will become apparent from the following detailed description taken in conjunction with the drawings, in which.

Figure 2:
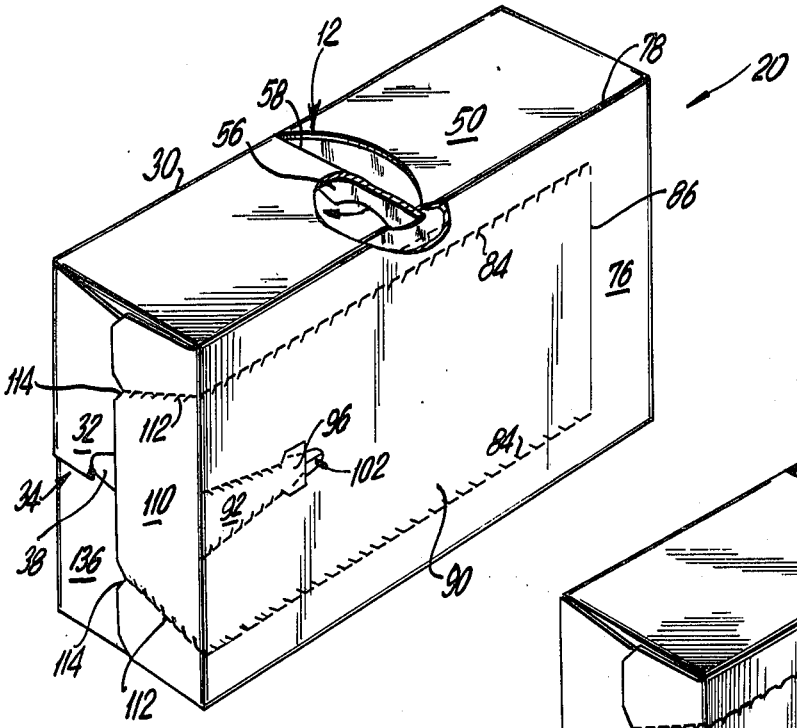
FIG. 2 is a perspective view, partially in section of the erected carrier of the subject invention particularly illustrating the new and improved handle means.
Figure 4:
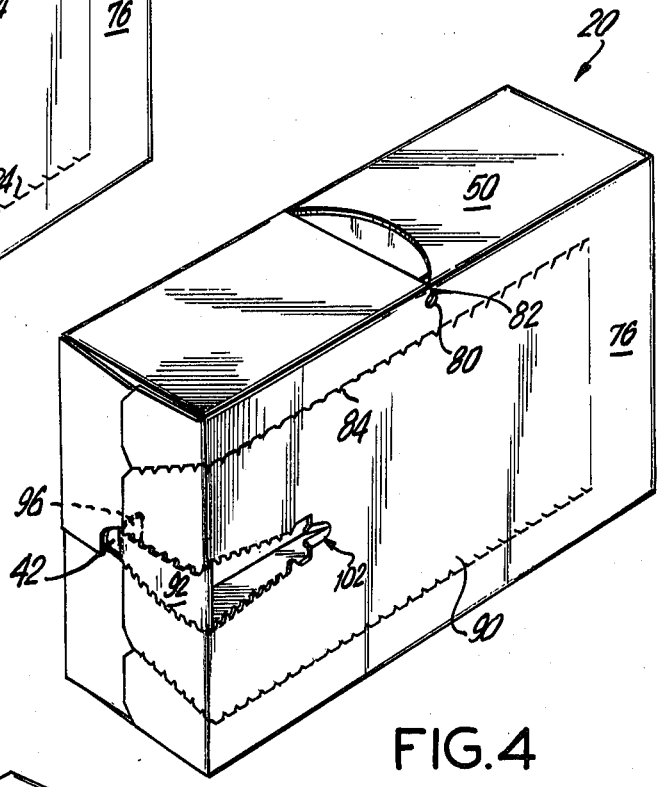
FIG. 4 is a perspective view of the carrier of the subject invention illustrating the use of the locking means.
Figure 3:
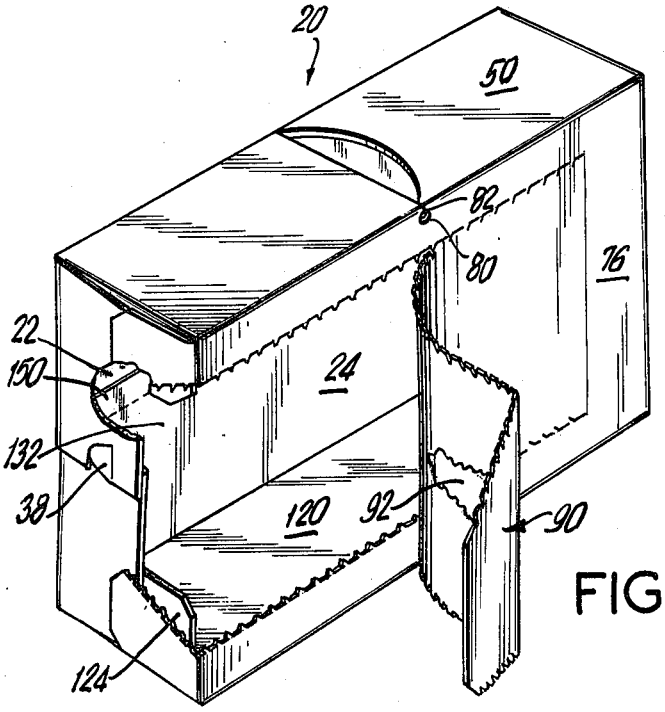
FIG. 3 is a perspective view of the article carrier of the subject invention illustrating the outwardly flexed position of the openable flap.

The article carrier of the subject invention, as illustrated in FIGS. 2–4, is indicated generally by the numeral 20, and is formed from a top panel 50, an opposed bottom panel 120, and opposed first and second side panels 76, 24, which are alternatively hingedly connected to form a tubular configuration. End cover flaps, for sealing the carrier, are provided at the opposed ends of the tubular configuration. The new and improved handle means 12 is formed in the top panel 50 as well as the opposed side panels 24, 76. The openable flap 90 is formed in the first side panel 76 and extends into the primary cover flap 110. A locking strap 92 is provided in first side panel 76 for reclosing the openable flap 90 as more fully described hereinafter.

Figure 1:
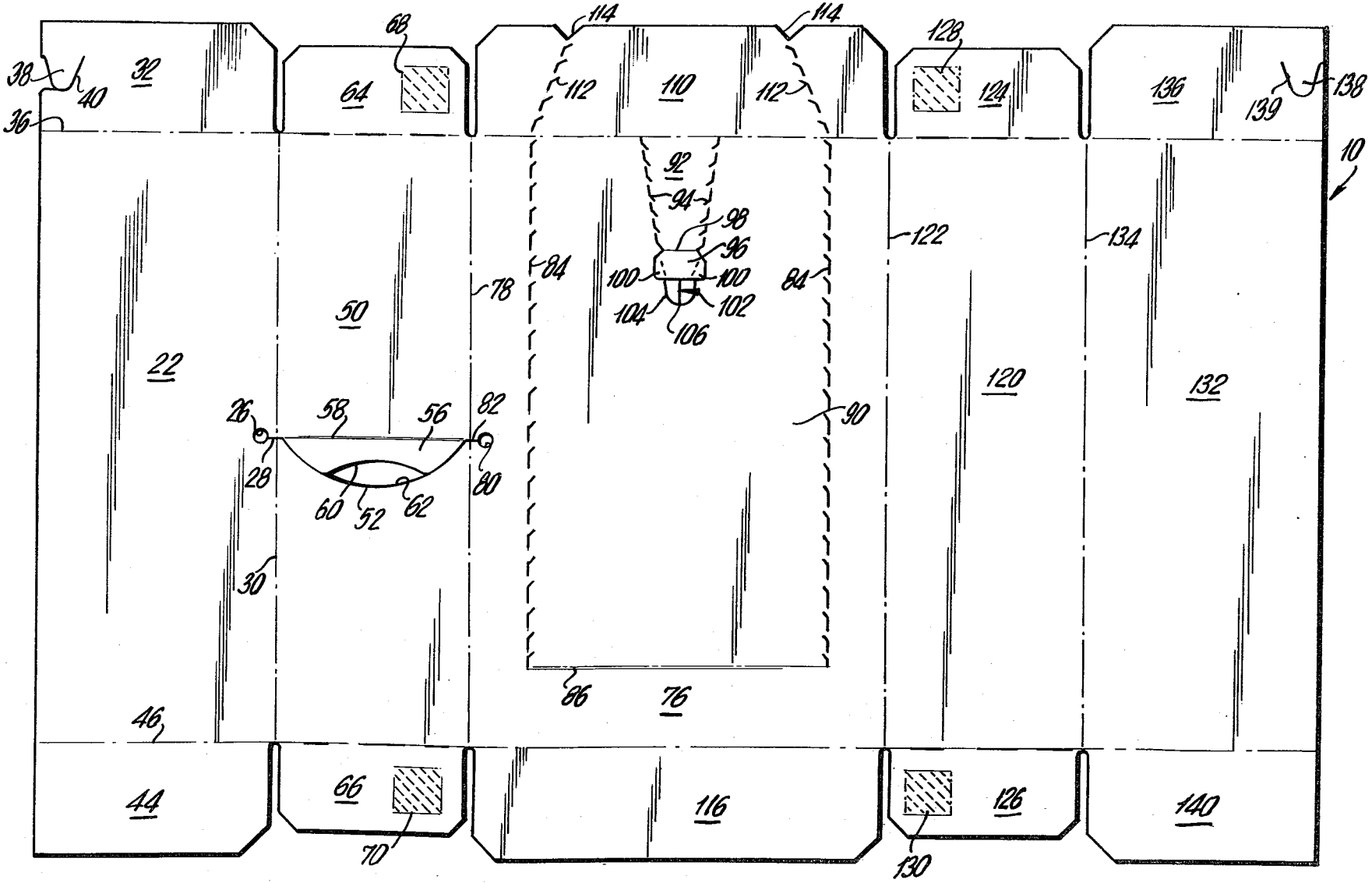
FIG. 1 is a plan view of the blank adapted to be folded into the carrier of the subject invention.

Referring now more particularly to FIG. 1, a plan view of the blank 10 adapted to be folded into the carrier 20 of the subject invention is illustrated. The blank 10 has a generally rectangular configuration which minimizes the amount of paperboard necessary to form the blank 10. The blank 10 includes a first side panel 76, top and bottom panels 50 and 120 and inner and outer portions 132, 22 which form the second side panel 24. The panels are hingedly connected along parallel hinge lines, and the blank 10 is further provided with a plurality of end cover flaps which are hingedly connected to the opposed ends of the panels.

More specifically, and as viewed from the left side of the FIG. 1, the blank 10 includes outer portion 22 of a second side panel 24. Outer portion 22 is provided with first stress relieving aperture 26 which is contiguous with the distal end of first straight portion 28 of the cut line which defines the handle means of the subject invention. First straight portion 28 of the cut line extends generally orthogonally from hinge line 30.

The blank 10 of the subject invention is further provided with outer portion 32 of a secondary cover flap 34 which is hingedly connected to the outer portion 22 of the second side panel 24 along hinge line 36. Outer portion 32 of secondary cover flap 34 is provided with a shiftable tab 38 defined by cut line 40. Shiftable tab 38 when pivoted out of the plane of the paperboard defines locking aperture 42 which is part of the locking means of the subject carrier 20 as more fully described hereinafter. An end cover flap 44 is hingedly connected to the outer portion 22 of second side panel 24 along hinge line 46.

Top panel 50 is hingedly connected to the outer portion 22 of second side panel 24 along the hinge line 30 and is provided with a generally arcuate cut line 52 extending between the hinge line 30 and opposed hinge line 78. Cut line 52 functions to define a handle tab 56 which is pivotally connected to the top panel 50 along hinge line 58. In the blank 10, hinge line 58 is colinear with the first straight segment 28 of the cut line and is coplanar with that segment in the erected carrier 20 to thereby maximize the stress relieving function of the apertures. A die cut 60 may be provided which defines aperture 62 to facilitate the initial flexing of the handle tab 56. End cover flaps 64 and 66 are hingedly connected to the opposed ends of top panel 50 along hinge lines 36 and 46, respectively. Embossed areas 68 and 70 are provided on end cover flaps 64 and 66 to facilitate the gluing of the end closures.

First side panel 76 is provided and is hingedly connected to the top panel 50 along hinge line 78. First side panel 76 is provided with second stress relieving aperture 80 which is contiguous with the distal end of the second straight portion 82 of the cut line of the handle means. Similar to the first straight cut portion 28, second straight cut portion 82 is disposed generally orthogonal to the hinge line 54 and, in the erected carrier 20, is coplanar with hinge line 58 of handle tab 56.

First side panel 76 is further provided with a first pair of spaced apart cut score lines 84 which are perpendicular to and extend from hinge line 36, to a point intermediate the length of the panel 76. A hinge line 86 may be provided to connect the spaced apart pair of cut score lines 84 to define the openable flap 90.

First side panel 76 is additionally provided with a locking strap 92 which is hingedly connected to the blank along hinge line 36. Locking strap 92 is formed in first side panel 76 and is hingedly connected thereto along hinge line 98. Locking strap 92 is defined by cut score lines 94 and includes a locking tab 96 disposed at the opposed end thereof. The locking tab 96 is provided with two, generally triangular foldable sections 100 which aid in the interengagement of the locking tab 96 with the locking aperture 42 as more fully described hereinafter. First side panel 76 is further provided with a finger aperture 102 which is defined by an arcuate cut line 104 as well as a bisecting cut line 106 such that in the erected carrier 20, the paperboard may be flexed inwardly to define finger aperture 102 which facilitates the initial tearing of the locking strap 92.

Primary cover flap 110 is hingedly connected to the first side panel 76 along hinge line 36 and is provided with a second pair of spaced apart cut score lines 112 which extend from the hinged connection 36 to the opposed end of the flap. In a preferred embodiment, the second pair of spaced apart cut line 112 extend from a point along the hinged connection 36 adjacent the respective first pair of spaced apart cut lines 84, and angle inwardly to terminate adjacent a pair of V-shaped cuts 114. V-shaped cuts 114 are provided to facilitate the opening of the openable flap 90. An end cover flap 116 is provided on the opposed end of the first side panel 76 and is hingedly connected thereto along hine line 46.

A bottom panel 120 is hingedly connected to the opposed side edge of first side panel 76 along hinge line 122, and is provided with opposed end cover flaps 124 and 126 which are connected along hinge lines 36 and 46 respectively. End cover flaps 124 and 126 are provided with embossed areas 128 and 130 to facilitate the sealing of the end closures of the carrier. Inner portion 132 of second side panel 24 is hingedly connected to the bottom panel 120 along hinge line 134. Inner portion 136 of secondary cover flap 34 is hingedly connected to the top edge of the inner portion 132 of second side panel 24 along hinge line 36. Inner portion 136 of secondary cover flap 34 is provided with shiftable tab 138 defined by cut line 139. Shiftable tab 138 is disposed to be in registration with tab 38 and may be pivoted out of the plane of flap 34 to form locking aperture 42 in the erected carrier 20. An end cover flap 140 is hingedly connected along the opposed end of inner portion 132 along hinge line 46.

The carrier 20 of the subject invention is formed from the blank 10 by folding the top and bottom panels 50, 120, as well as the inner and outer portion 132, 22 of second side panel 24 about their respective hinged connections thereby forming a generally rectangular tubular configuration. More specifically, top panel 50 is rotated out of the plane of the blank 10, about hinge line 78, while bottom panel 120 is similarly rotated about hinge line 122. Inner portion 132 of second side panel 24 is then rotated around the hinged connection 134 followed by the folding of outer portion 22 about hinge line 30 such that a portion of outer portion 22 overlaps and is adhesively connected to the inner portion 132. As illustrated in FIG. 3, the overlap of outer portion 22 over inner portion 132 creates a reinforcing strip 150 which extends along the length of second side panel 24. Reinforcing strip 150 functions to maintain the structural rigidity of the carrier after the openable flap 90 has been initially opened.

After the carrier 20 is filled the end closures are formed by first folding inwardly cover flaps 64, 66, 124, and 126. Cover flaps 136 and 140 are then folded into abutting relationship and adhesively connected to flaps 126 and 124. Thereafter, flaps 32 and 44 are folded into abutting relationship with panels 64 and 66 and are adhesively connected thereto. Finally, flaps 110 and 116 are folded over into abutting relationship with the other end cover flaps and are adhesively connected thereto thereby forming the erected carrier 20 as illustrated in FIG. 2. The width of primary cover flap 110 is such that the flap only partially overlaps secondary cover flap 34 thereby leaving locking aperture 42 unobstructed.

In use, the carrier 20 of the subject invention is intended to hold and carry heavy articles such as a plurality of 6-packs of soda or beer. In accordance with the subject invention a new and improved handle means is provided such that the consumer may readily transport the carrier when it is fully loaded with its heavy contents. More particularly, the handle tab 56 is pivoted into the carrier 20 about hinge line 58, as illustrated in FIG. 2. The user may then insert a hand into the aperture created by the displacement of the handle tab 56 enabling him to grasp the carrier 20 along the top panel 50. As the carrier 20 is lifted, the top panel 50 tends to bow or flex upwardly creating local stress along the hinge line 58 of the handle tab 56, which would tend to tear the paperboard in the area at the opposed ends of the hinge line 56. In order to prevent the unwanted and inadvertent tearing of the paperboard, first and second straight cut portions 28 and 82 are provided in the opposed side panels 76 and 24 as well as stress relieving apertures 26 and 80. By this arrangement, the upward biasing of the handle means and the resultant local stress produced thereby, is distributed over the area of the paperboard defined by stress relieving apertures 26 and 80, rather than at the end points of the hinge line 56. Thus, a relatively heavy load may be transported in the carrier 20 without the paperboard being inadvertently torn or deformed.

The preferred form of the carrier 20 disclosed in the drawings is also provided with a new and improved openable flap and locking means therefor. More specifically, openable flap 90 which is defined by first and second spaced apart pairs of cut score lines 84 and 112, may be torn away from the carton to expose the contents therein so that the user may readily remove them. The openable flap 90 is flexed outwardly by supplying an outwardly biasing force to the primary cover flap 110 in the area between the V-shaped notches 114. This biasing force results in the tearing of the second pair of spaced apart cut score lines 112, with continued force resulting in the tearing of the first pair of spaced apart cut score lines 84. The openable panel 90 is then flexed outwardly away from the carton to readily expose the contents therein. The user may choose to open the flap 90 the full length of the second pair of cut score lines 84 or may only partially outwardly flex the flap 90. In practice, to maintain the structural integrity of the carrier 20, the flap 90 should be torn to a point only as far as necessary to provide access to the contents of the carrier.

In the preferred form of the carrier 20, a new and improved means for relocking the openable flap 90 is provided. More specifically, locking strap 92 is provided which may be folded over and interlocked with locking aperture 42, as illustrated in FIG. 4. Locking strap 92 is torn from openable flap 90 by first inserting a finger into finger aperture 102 which is defined by cut lines 104, 106 such that the user may grasp the locking tab 96 to outwardly bias the strap 92 away from the flap 90 thereby tearing cut score lines 94. The locking strap 92 is then pivoted about hinge line 36 such that the locking tab 96 is adjacent the locking aperture 42. The length of locking strap 92 is such that it will extend beyond the primary cover flap 110 and reach the locking aperture 42 formed in the non-overlapped portion of secondary cover flap 32. Locking aperture 42 is created by inward flexing registered tabs 38, 138 which are defined by cut lines 40 and 138. Locking tab 96 may then be interengaged with locking aperture 42 by flexing the triangular panels 100 such that the tab 96 may be interfit with the aperture 42. After insertion of the locking tab 96 into locking aperture 42, the triangular portions 100 of locking tab 96 expand such that the strap 92 will stay in the locked position. As illustrated in FIG. 4, by this arrangement the openable flap 90 is held in its initial position whereby the carrier 20 may again be transported, with the danger of the contents spilling out being substantially reduced. It is preferred that the size of locking strap 92 be smaller than the size of a single article which is held within the carrier 20 such that an article will not inadvertently fall out of the carrier 20 through the opening created by the strap 92.

Accordingly, there is provided a new and improved article carrier and a blank for forming the same which consists of opposed top and bottom panels, as well as first and second side panels which are alternatively hingedly connected to form a generally rectangular tubular configuration. A handle means is provided which is defined by a cut line, having an arcuate portion disposed in the top panel of the carrier which extends between the hinged connections with the opposed first and second side panels, and defines a pivotable handle tab. The cut line is additionally provided with a pair of opposed straight portions which extend into the opposed side panels and are coplanar with the hinged connection of the shiftable handle tab. In addition, a pair of stress relieving apertures are provided in the opposed side panels and are contiguous with the straight portions of the cut line. By this arrangement, when the carrier is transported via the handle means, stress created along the hinged connection of the handle tab is distributed to the apertures, disposed in the side panels, thereby reducing the likelihood of the tearing of the carton. The article carrier may be optionally provided with an openable flap which is defined by two pairs of spaced apart cut score lines which are disposed in the first side panel and extend into the primary cover flap. As a further option, a locking means may be provided which consists of a locking strap formed in the openable flap and is pivotally connected to the first side panel. The locking strap is provided with a locking tab which is capable of interengagement with a locking aperture provided in the secondary cover flap to reseal the carrier. It is to be noted that the handle means described and claimed therein may be employed in connection with various types of carton configurations, including those not provided with openable or reclosable flaps as disclosed herein. However, in the preferred form of the invention depicted in the drawings, the handle means is advantageously combined with the openable flap and associated locking means.

Although the subject carrier has been described by a reference to a preferred embodiment, it is apparent that other modifications could be devised by those skilled in the art that would fall within the scope and spirit of the present invention as defined by the appended claims.

What is claimed is:

1. A blank for forming an article carrier with an integral handle comprising:

a first side panel;

a top panel hingedly connected along one side edge of said first side panel;

a bottom panel hingedly connected along the opposed side edge of said first side panel;

an outer side panel, said outer side panel being hingedly connected to the opposed side edge of said top panel;

an inner side panel, said inner side panel being hingedly connected to the opposed side edge of said bottom panel; and handle means, said handle means including a cut line, said cut line having an arcuate portion disposed in said top panel and extending between the opposed side edges of said top panel and defining a handle tab, said cut line further including a pair of opposed straight portions disposed in said opposed outer and first side panels, said straight portions of said cut line being colinear with the hinged connection to said handle tab, said handle means further including a pair of stress relieving apertures being respectively disposed in said outer and first side panels, said stress relieving apertures being contiguous with the distal ends of said straight portions of said cut line.

2. A blank for forming an article carrier as recited in claim 1 further including:

first and second primary cover flaps respectively hingedly connected to the opposed end of said first side panel;

first and second inner secondary cover flaps respectively hingedly connected to the opposed ends of said inner side panel; and first and second outer secondary cover flaps respectively hingedly connected to the opposed ends of said outer side panel.

3. An article carrier with an integral handle comprising:

a pair of opposed top and bottom panels;

a pair of opposed first and second side panels, with said top, bottom and side panels alternatively hingedly connected to form a generally rectangular tubular configuration; and handle means, said handle means being defined by a cut line, said cut line having a generally arcuate portion disposed in said top panel and extending between the opposed side edges of said top panel adjacent said side panels, with the arcuate portion of said cut line defining a handle tab, said cut line additionally having a pair of straight portions which extend a short distance beyond the side edges of said top panel and into the opposed side panels, with said straight portions of said cut line being disposed in orthogonal relationship to the hinged connections between said top panels and said opposed side panels, said handle means further including a pair of stress relieving apertures respectively disposed in the opposed side panels, said apertures being contiguous with the distal ends of the associated straight portions of said cut line, said handle tab being foldable out of the plane of said top panel along a hinge line coplanar with said straight portions of said cut line, such that an opening is created in said top panel for the carrying of said carton, whereby said stress relieving apertures function to reduce the likelihood of tearing adjacent the opposed ends of said cut line.

4. An article carrier as recited in claim 3, including first and second end closures hingedly connected to the opposed ends of said tubular configuration.

5. An article carrier as recited in claim 3 wherein said handle tab is semi-circular in configuration.

6. An article carrier as recited in claim 3 wherein said handle tab is foldable inwardly into said carrier and into abutting relationship with the inner surface of said top panel.

7. An article carrier as recited in claim 3 wherein said second side panel is formed from an inner and an outer panel which partially overlap and are adhesively connected to form a reinforcing strip for increasing the structural rigidity of the carrier.

* * * * *

UNITED STATES PATENT AND TRADEMARK OFFICE

CERTIFICATE OF CORRECTION

PATENT NO. : 4,405,078

DATED : September 20, 1983

INVENTOR(S) : Daniel P. Dutcher

It is certified that error appears in the above—identified patent and that said Letters Patent is hereby corrected as shown below:

On the title page:

The listing of inventors is in error and the inventor "Harry I. Roccaforte", Western Springs, Ill." should be deleted and the semicolon (;) after the word "Minn." should be changed to -- . -- .

Signed and Sealed this

*Fifteenth* Day of *May 1984*

[SEAL]

*Attest:*

GERALD J. MOSSINGHOFF

*Attesting Officer*

*Commissioner of Patents and Trademarks*